US005595196A

United States Patent [19]

Salonen et al.

[11] Patent Number: 5,595,196

[45] Date of Patent: Jan. 21, 1997

[54] METHOD OF PRODUCING A FILTER CIGARETTE WITH TIPPING PAPER HAVING LIP RELEASE PROPERTIES

[75] Inventors: Hannu Salonen; Helena Kanervo, both of Tervakoski, Finland

[73] Assignee: Enso-Gutzeit Oy, Tervakoski, Finland

[21] Appl. No.: 461,290

[22] Filed: Jun. 5, 1995

Related U.S. Application Data

[63] Continuation-in-part of Ser. No. 79,782, Jun. 22, 1993, abandoned, which is a continuation-in-part of Ser. No. 888,487, May 27, 1992, abandoned.

[51] Int. Cl.[6] ..... A24C 5/52

[52] U.S. Cl. ..... 131/362

[58] Field of Search ..... 131/362, 365

[56] References Cited

U.S. PATENT DOCUMENTS

| | | | |
|---|---|---|---|
| 1,507,925 | 9/1924 | Marshall | 131/362 |
| 2,033,791 | 3/1936 | Sulzberger | 131/362 |
| 2,217,527 | 10/1940 | Roon | 131/362 |
| 2,272,206 | 2/1942 | Jarobowitz | 131/362 |
| 3,006,806 | 10/1961 | Schur | 162/139 |
| 4,185,643 | 1/1980 | Riedesser | 131/365 |
| 4,340,074 | 7/1982 | Tudor | 131/362 |
| 4,450,847 | 5/1984 | Owens | 131/365 |
| 4,721,120 | 1/1988 | Greig et al. | 131/365 |
| 4,805,644 | 2/1989 | Hampl, Jr. et al. | 131/365 |
| 5,072,743 | 12/1991 | Perrine | 131/365 |
| 5,125,421 | 6/1992 | Mitchell | 131/362 |

FOREIGN PATENT DOCUMENTS

| | | |
|---|---|---|
| 130950 | 5/1977 | German Dem. Rep. . |
| 425254 | 3/1935 | United Kingdom . |
| 908988 | 10/1962 | United Kingdom . |

*Primary Examiner*—William H. Grieb

*Attorney, Agent, or Firm*—Ronald J. Kubovcik; James C. Lydon

[57] ABSTRACT

A method for producing a filter cigarette with tipping paper having improved lip release properties. Lip release chemicals are applied to one side of a base tipping paper during its manufacture in a papermaking process by surface coating, followed by manufacture of the cigarette using otherwise conventional apparatus and materials according to known procedures.

6 Claims, 1 Drawing Sheet

METHOD OF PRODUCING A FILTER CIGARETTE WITH TIPPING PAPER HAVING LIP RELEASE PROPERTIES

BACKGROUND OF THE INVENTION

This application is a continuation-in-part of U.S. application Ser. No. 08/079,782, filed Jun. 22, 1993 and now abandoned, which is a continuation-in-part of U.S. application Ser. No. 07/888,487, filed May 27, 1992 and now abandoned.

This invention relates to an improved method of manufacturing a filter cigarette with a tipping paper having lip release properties. More particularly, the invention relates to a method of imparting lip release properties to a base tipping paper during the production of the base tipping paper in a paper machine followed by manufacturing the cigarette itself.

Tipping paper is the outermost paper of the filter section of a cigarette and is used to join the tobacco-containing section to the filter section. It is important to a cigarette smoker that the cigarette filter section does not adhere to his lips. Within the cigarette industry, the terminology "lip release properties" is used to describe the release of contact between human lips and the filter section of a cigarette. In order to achieve acceptable lip release properties, tipping paper is chemically treated.

Tipping paper must fulfill several other functional requirements beyond (1) joining the filter section to the tobacco-containing section and (2) possessing acceptable lip release properties. More particularly, the tipping paper must also be printable with logo and designs, and must also be easily perforated by electrostatic or laser means. Finally, the tipping paper must be easily slit and capable of being run in a cigarette manufacturing machine typically producing from 8,000 to 14,000 cigarettes per minute. This requires the cigarette tipping paper to be curled, glued and seam-sealed without air leakage to form a straight, neat longitudinal seam forming a cylinder which encompasses the filter section and an adjoining portion of the cigarette-containing section of a filter cigarette, all within a fraction of a second.

The characteristics of the cigarette tipping paper are carefully controlled in order to permit high speed operation of the cigarette manufacturing machine. In particular, the perforations must be uniform and the "back side gluability" of the tipping paper is critical. "Back side gluability" refers to the propensity of the paper to accept a coating of glue so that the tipping paper can be curled around the filter section and a portion of the adjoining tobacco containing section and glued to form the completed filter cigarette.

Conventionally, base tipping paper is manufactured by a paper making machine, and the lip-release properties are later added in conjunction with the printing stage. U.S. Pat. No. 4,340,074 to Tudor describes a method for obtaining the lip-release properties in conjunction with the printing stage. The printing stage always forms a separate process step, and printing cannot be performed along with the manufacturing process of the base tipping paper.

The importance of the claimed process will be appreciated in the context of the development of commercial cigarette production. In 1973–74 cigarette manufacturers used highly sized tipping paper, and cigarette machines produced 4,000–5,000 cigarettes per minute. Today's cigarette machines run at speeds of 8,000–14,000 cigarettes per minute. Introduction of higher speed machines required lower sizing amounts, and cigarette manufacturers switched to printing nitrocellulose on the previously-formed tipping paper to impart lip release properties. However, nitrocellulose presents problems in terms of costs and pollution.

In the prior art method, the lip release properties are imparted to base tipping paper during the printing operation with solvent-based lip release chemicals, such as nitrocellulose. Due to the strict environmental legislation in the United States, there is a need to substantially reduce the use of solvent-based lip release chemicals.

Surface sizing of base tipping paper is also conventionally employed in conjunction with the production of the base tipping paper. The purpose of surface sizing is to optimally condition the surface of the base tipping paper for printing and to improve the runnability of the base tipping paper in the cigarette manufacturing machine.

An object of this invention is to produce an improved filter cigarette which has superior lip release properties.

Another object is to achieve a more efficient method of producing a filter cigarette.

SUMMARY OF THE INVENTION

The present invention relates to a method of producing a filter cigarette having a filter section joined to a tobacco section by a tipping paper having improved lip release properties, comprising placing a tobacco section and a filter section in end-to-end longitudinal axial relationship; and joining the filter section and tobacco section together by wrapping a tipping paper around the filter section and an adjoining portion of the cigarette section, said tipping paper possessing lip release properties which were previously imparted thereto by applying a surface coating composition containing a lip release chemical to only one side of a base tipping paper during a stage of a papermaking process for manufacturing the base tipping paper.

BRIEF DESCRIPTION OF THE DRAWING

The drawing is a diagram illustrating the sections and stages of a papermaking machine used for manufacturing base tipping paper suitable for subsequently manufacturing a filter cigarette.

DESCRIPTION OF PREFERRED EMBODIMENTS

Figure 1:
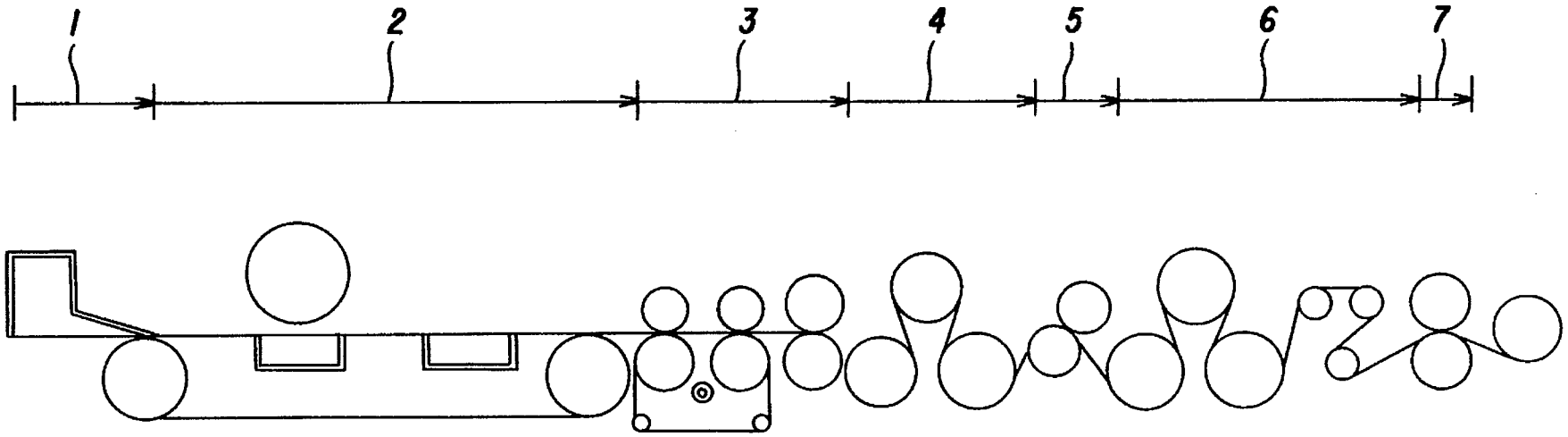

"Tipping paper" is the paper which forms the exterior surface covering the filter section of a filter cigarette. It is manufactured from "base tipping paper" by printing the base tipping paper with a corporate logo and/or other design and by perforation to permit air to be drawn from the outside through the filter section when the smoker inhales.

A. Manufacture of Base Tipping Paper

Base tipping paper is manufactured from paper pulp and filler using a conventional papermaking machine. Surface coating is a conventionally known step of a papermaking process. In the present invention, lip release properties are imparted to base tipping paper during its manufacture by adding one or more additives which impart lip release properties (lip release chemicals) to the coating components conventionally used in these steps.

The drawing schematically illustrates a papermaking machine. The various sections of the machine correspond to stages of the process for manufacturing base tipping paper. As shown in the drawing, the papermaking machine includes a head box 1, wire section 2, press section 3, drying section 4, coating unit 5, drying section 6 and calendering section 7.

In the method of the present invention, lip release properties are imparted to base tipping paper by adding lip release compounds to the coating chemicals applied to the base tipping paper by the coating unit 5.

The lip release chemicals used in the present invention to provide the base tipping include silicone compounds and polyvinyl acetate/butylacrylate copolymers. Vinylacetate/butylacrylate polymer-based compositions are particularly preferred and are commercially available from Raisio Chemicals Oy, Finland, under the trademarks REBARCO EP 740,741 and 742.

In the context of the present invention, "surface coating" refers to pigment coating, which is performed by applying onto the paper web surface a pigment/binder mixture complemented according to the present invention with one or more chemicals which impart lip-release properties. The coating operation can be performed using a coater operating in-line with the paper machine. A preferred in-line coating apparatus is commercially available from Valmet Paper Machinery Inc. under the name Sym-Sizer.

The pigment-containing coating composition used in the present invention typically contains (a) at least one pigment, (b) at least one binder, (c) at least one lip release compound, and (d) water.

Pigments which may be employed in the surface coating composition include kaolins, oxides such as titanium dioxide and aluminum hydroxide, carbonates such as precipitated $CaCO_3$ and ground $CaCO_3$, sulfates and sulfides such as barium sulfate and gypsum. Binders which may be used in the surface coating composition include starch, cellulose ethers and esters, mannogalactans, alginates, proteins, acrylates, butadienes, PVA and PVac. Typical amounts for the pigments, binders, lip release chemicals and other additives are set forth below:

Pigments: 70 to 80%

Binder: 10 to 15%

Lip Release Chemicals: 1.0 to 15%

Other Additives: 0 to 5%

To achieve the desired combination of properties of the base tipping paper, particularly "backside gluability", the lip-release property should be imparted to one side of the paper web only. By applying the pigment coat only on one side of the base tipping paper, the other side can be produced in the conventional fashion to impart acceptable gluing characteristics thereto. Thus, the lip-release property is imparted only to that side of the web that in a finished cigarette defines the exterior surface, without affecting the "backside gluability" of the base tipping paper.

The base tipping paper produced according to the method of the present invention typically has a basis weight of 28 to 40 g/m$^2$, an opacity of 80 to 95%, a brightness range of 80 to 90% for white base tipping paper and 15 to 30% for yellow base tipping paper and a porosity of 200 to 4000 Gurley seconds. A surface coating composition in an amount of 0.2–6 g/m$^2$ is preferably applied to one side of the paper, i.e., the side to be printed. The other side of the paper may be simultaneously treated to allow conventional gluing properties to be imparted thereto.

Internal sizing should not be used to impart the lip release property to the base tipping paper because it will affect both sides of the tipping paper and adversely affect properties such as "backside gluability".

EXAMPLES

Example 1

A base tipping paper having acceptable lip release properties was obtained by surface coating a base tipping paper using a coating unit 5 in a papermaking machine, as illustrated in the drawing. The surface coating used in Example 1 contained the following components:

| | Parts |
|---|---|
| Pigment: kaolin[1] | 100 (70.4 wt %) |
| Binder: latex[2] | 17 (12.0 wt %) |
| Lip-release additive: paraffin wax[3] | 29 (17.6 wt %) |

[1]Coating grade.
[2]Polymer of vinylacetate/acrylic- and methacrylic esters (known in the paper industry as a binder for coating color).
[3]Fully refined paraffin wax consisting mainly of straight chain hydrocarbon molecules and having a melting point of 145° F., oil content of 0.6 wt % and density (15° C.) of 0.898 g/cm$^3$.

Example 2

A surface coating composition containing a silicone resin (84.2 wt %) of the type conventionally used as a release agent for labels and a starch (15.8 wt %) is applied to a base tipping paper in a coating unit 5 in a papermaking machine as shown in the drawing to provide acceptable lip release properties.

Example 3

Advantageous lip release results were achieved while surface coating a tipping paper in a coating unit 5 in a papermaking machine as illustrated in the drawing using the following composition:

| | |
|---|---|
| Starch | (33.2%) |
| Fire retardant | (29.4%) |
| Wet strength chemical | (3.7%) |
| Mannogalactan | (8.5%) |
| Wax | (25.2%) |

For those versed in the art, it is obvious that the invention is not limited to the above examples described, but instead, can be varied within the scope of the appended claims.

B. Conversion of Base Tipping Paper Into Tipping Paper

The base tipping paper may be printed with a logo and is perforated using conventional perforation means such as electrostatic perforation or laser perforation. Those of ordinary skill in this art are quite familiar with such printing and perforation operations, as illustrated by U.S. Pat. Nos. 4,608,037 and 5,341,824, the disclosures of which are expressly incorporated herein by reference in their entirety.

The printed and perforated base tipping paper is typically slit and wound onto bobbins prior to being used in the manufacture of a filter cigarette. Again, those of ordinary skill in the art are familiar with such conventional winding processes.

C. Manufacture of a Filter Cigarette Using Tipping Paper

The tipping paper having improved lip release properties may be employed in conventional manner on a conventional cigarette machine to manufacture the filter cigarette of the present invention. More particularly, the tipping paper is unwound from the roll, slit into a desired width, and employed to join a filter section to a cigarette containing section in longitudinal axial alignment according to conventional techniques using conventional apparatus.

The claimed process permits application of lip release properties to base tipping paper without using solvent-based lip release chemicals, and produces a filter cigarette which exhibits good lip release properties without requiring organic solvents in its manufacture or an inefficient off-line coating apparatus. An important consequence of the single side application feature is that the base tipping paper's "back-side gluability" properties are maintained, i.e., the base tipping paper is subsequently effectively glued to the filter portion of a cigarette, without interference from the lip release chemical.

What is claimed is:

1. A method of producing a filter cigarette having a filter section joined to a tobacco section by a tipping paper having improved lip release properties, comprising:

placing a tobacco section and a filter section in longitudinal axial relationship; and joining said filter section and tobacco section together by wrapping a tipping paper around said filter section and an adjoining portion of said tobacco section, said tipping paper possessing lip release properties which were imparted thereto by applying a surface coating containing a lip release chemical to only one side of a base tipping paper during a stage of a papermaking process for manufacturing the base tipping paper.

2. The method of claim 1, wherein the lip release chemical is selected from the group consisting of paraffin waxes, silicone resins and hydrophobic neutral sizing agents.

3. The method of claim 1, wherein the surface coating composition further comprises a pigment and a binder.

4. The method of claim 1, wherein the surface coating comprises a silicone resin and a starch.

5. The method of claim 1, wherein said one side of the base tipping paper is the side to be printed.

6. The method of claim 1, wherein said lip release chemical is a polyvinyl acetate/butylacrylate copolymer.

* * * * *